United States Patent [19]

Rohde

[11] Patent Number: 4,932,212

[45] Date of Patent: Jun. 12, 1990

[54] PROCESS FOR THE PRODUCTION OF CRUDE ARGON

[75] Inventor: Wilhelm Rohde, Munich, Fed. Rep. of Germany

[73] Assignee: Linde Aktiengesellschaft, Wiesbaden, Fed. Rep. of Germany

[21] Appl. No.: 421,563

[22] Filed: Oct. 11, 1989

[30] Foreign Application Priority Data

Oct. 12, 1988 [DE] Fed. Rep. of Germany ..... 3834793

[51] Int. Cl.[5] ..... F25J 3/04

[52] U.S. Cl. ..... 62/22; 55/66

[58] Field of Search ..... 62/22, 24; 55/66

[56] References Cited

U.S. PATENT DOCUMENTS

| | | | |
|---|---|---|---|
| 2,982,107 | 5/1961 | Smith | 62/22 |
| 3,181,306 | 5/1965 | Geist et al. | 62/22 |
| 3,222,878 | 12/1965 | Becker | 62/22 |
| 3,596,471 | 8/1971 | Streich | 62/22 |
| 3,688,513 | 9/1972 | Streich et al. | 62/22 |
| 4,615,716 | 10/1986 | Cormier | 62/22 |
| 4,705,548 | 11/1987 | Agrawal et al. | 62/22 |
| 4,790,866 | 12/1988 | Rathbone | 62/22 |
| 4,817,394 | 4/1989 | Erikson | 62/22 |

*Primary Examiner*—Ronald C. Capossela

*Attorney, Agent, or Firm*—Millen, White & Zelano

[57] ABSTRACT

A process is disclosed for producing gaseous crude argon by low-temperature rectification of air wherein a portion of the compressed air is further compressed. The further compressed air is partially liquefied by countercurrent heat exchange with evaporating crude argon obtained in the liquid phase, this crude argon being under elevated pressure.

22 Claims, 1 Drawing Sheet

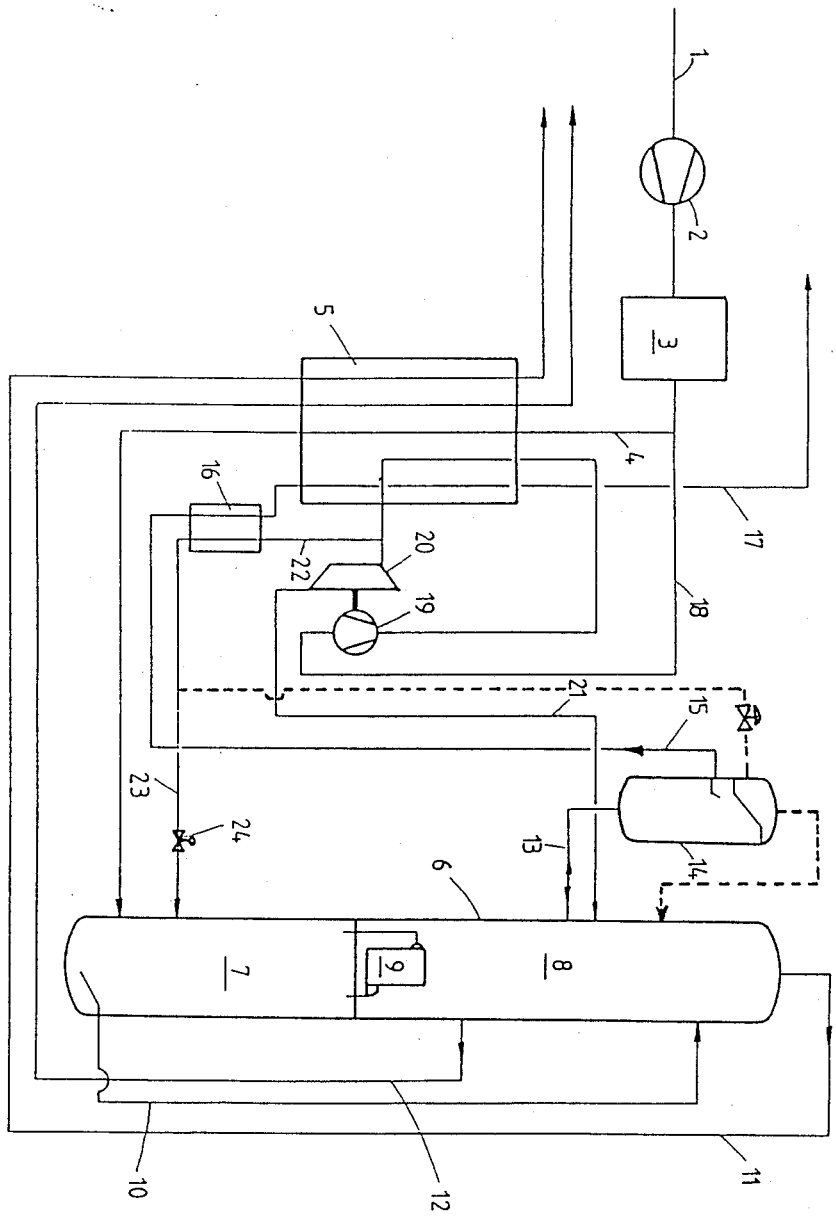
1
2
3
4
5
6
7
8
9
10
11
12
13
14
15
16
17
18
19
20
21
22
23
24

PROCESS FOR THE PRODUCTION OF CRUDE ARGON

BACKGROUND OF THE INVENTION

The invention relates to a process for producing gaseous crude argon by low-temperature rectification of air wherein air is compressed, prepurified, cooled, and fed into a high-pressure stage of a two-stage rectification and wherein crude argon in the liquid phase is obtained downstream of the two-stage rectification.

Such a process is disclosed in DOS No. 3,428,968. Crude argon is withdrawn in the liquid phase from the head of a crude argon column or is liquefied after removal from a crude argon column. The liquid crude argon is subjected to a pressure increase, utilizing its hydrostatic potential, in order to raise the pressure of the crude argon, generally obtained under approximately atmospheric pressure, to the pressure of about 3.5–5 bar required for further processing. This mode of operation offers the saving advantage of eliminating the cost of a separate compressor for compression of the crude argon—required, for example, in the case of gaseous withdrawal of crude argon.

The crude argon, which is under elevated pressure, must be vaporized for obtaining pure argon. The refrigeration produced by evaporation is removed by heat exchange with nitrogen in the process of DOS No. 3,428,968. However, in the case of a low-pressure facility wherein the air is compressed to about 6 bar, such a process stream is not available under a sufficiently high enough pressure to result in the nitrogen being liquefied by heat exchange with the crude argon to be vaporized under elevated pressure. Thus, merely the sensible heat (the product of the heat capacity times the temperature difference) of the gaseous nitrogen rather than its latent heat of condensation is available for removing the cold of evaporation of the crude argon. As a result, the heat exchanger for crude argon evaporation must be relatively large in size. Furthermore, an amount of liquid equivalent to the quantity of crude argon withdrawn in the liquid phase must be fed into the rectification, and refrigeration must be additionally produced for this liquid at some other location.

SUMMARY OF THE INVENTION

An object of the invention is to provide an improved process of the type discussed hereinabove for the production of gaseous crude argon under elevated pressure wherein an especially high product output is attained with relatively low expenditures for energy and apparatus.

Upon further study of the specification and appended claims, further objects and advantages of this invention will become apparent to those skilled in the art.

These objects are achieved by branching off a partial stream of the compressed air prior to being cooled, the partial stream then being further compressed, cooled, partially engine-expanded and fed into the low-pressure stage of the rectification. Also, a portion of the further compressed air is branched off prior to engine expansion and brought into heat exchange with crude argon obtained in the liquid phase.

Compression of a partial stream of the air is known per se from German Pat. No. 2,854,508. In the process disclosed therein, which does not include a downstream crude argon production facility, the entire compressed air is engine-expanded.

In the process according to this invention, the air that is under elevated pressure is also utilized for transferring heat to liquid crude argon and to vaporize the latter during this heat transfer step. Since the compressed air is under increased pressure, it is liquefied during heat exchange with the vaporizing crude argon. Thus, the latent heat of the air is available for absorbing the cold of evaporation of the crude argon whereby, on the one hand, a relatively small process stream is adequate for evaporation and, on the other hand, liquid is produced which is required for the refrigeration balance of the rectification.

In this connection, it is advantageous to exploit the work obtained during expansion of the compressed air for the compression step. Accordingly, the pressure increase can be brought about without supplying external energy. The energy transfer is most effectively accomplished by mechanically coupling the compressor and the expansion engine.

In an advantageous further development of the invention, the unexpanded portion of the compressed air is passed onto the rectification after heat exchange with the crude argon obtained in the liquid phase. The air, liquefied for the most part during evaporation of the crude argon, can thus be utilized in the rectification as reflux, preferably in the high-pressure stage.

The unexpanded portion of the compressed air can, after heat exchange with the crude argon obtained in the liquid phase, also be brought into heat exchange with gas in the head of a crude argon column from which the crude argon is withdrawn, in order to advantageously exploit the peak refrigeration for liquid generation during rectification. The air vaporized during heat exchange can preferably be introduced into the low-pressure stage of the rectification column.

Generally, the amount of the air feedstream which is branched off prior to cooling, to form the partial stream of air which is subsequently further compressed, is about 5 to 35 vol. %, preferably 5 to 15 vol. %. Similarly, the amount of air which is branched off from the resultant further compressed partial stream of air, i.e., branched off prior to engine expansion, is about to 0,4 to 1,0 vol. %, preferably 0,6 to 0,9 vol. % of total feed air.

The oxygen stream which is removed from the low pressure stage of the two-stage rectification column and subsequently delivered to the crude argon column generally has an argon concentration of about 5 to 15 vol. %, preferably 8 to 12 vol. %. The crude argon product stream which is removed in a liquid phase or gaseous phase from the crude argon column generally has an argon concentration of about to 92 to 99 mol. %, preferably 95 to 98 mol. %.

With respect to the partial stream of compressed air, the crud argon product stream is generally compressed further to at least about 2,5 to 5,0 bar, preferably 3,5 to 4,5 bar.

BRIEF DESCRIPTION OF THE DRAWING

Various other objects, features and attendant advantages of the present invention will be more fully appreciated as the same becomes better understood when considered in conjunction with the accompanying drawing in which like reference characters designate the same or similar parts throughout the several views and wherein:

The figure illustrates a version of the process according to the invention from the step of taking in the air to be fractionated up to the step of vaporization and heating of the crude argon, the less essential and conventional process steps being shown in greatly simplified mode. The operating steps for the fine purification of the crude argon, following the crude argon evaporation, are not illustrated.

DETAILED DISCUSSION

Air is taken in via conduit 1, compressed in an air compressor 2 to a pressure of about 5 to 7 bar, prepurified in a purification stage 3—for example a molecular sieve system—and introduced via conduit 4 into a main heat exchanger 5 wherein the air is cooled counter-currently to product streams. The cold air is delivered to the high-pressure stage 7 of a two-stage rectifying column 6 operated under a pressure of about 5.0–7.0 bar and being in heat exchange communication with the low-pressure stage 8 by way of a condenser-evaporator 9.

From the bottom of the high-pressure stage 7, oxygen-enriched liquid is removed via conduit 10 and delivered via a throttle valve into the low-pressure stage 8 at a suitable location, the low-pressure stage 8 being under a pressure of about 1.0–2.0 bar. The low-pressure stage produces the product streams of nitrogen (conduit 11) and oxygen (conduit 12). These product streams are subsequently heated to almost ambient temperature in the main heat exchanger 5. Furthermore, another oxygen stream having a relatively high argon concentration is withdrawn via conduit 13 and introduced into a crude-argon column 14. This same conduit 13 is also utilized for allowing liquid from the crude argon column 14 to flow back into the low-pressure stage 8.

Liquid crude argon (conduit 15) is withdrawn from the crude argon column 14 as product. The crude argon could also be removed entirely or in part in the gaseous phase and then liquefied, as proposed in DOS No. 3,428,968. The liquid crude argon experiences, by utilization of the hydrostatic potential of about 30–40 meters along conduit 15, an increase in pressure to about 3.0–5.0 bar, preferably about 4.0 bar. The liquid crude argon is vaporized in a crude argon evaporator 16, heated in the main heat exchange 5 to about ambient temperature, and passed on via conduit 17 to a further purification stage.

According to this invention, a portion of the air is branched off, after preliminary purification in stage 3, via conduit 18, further compressed in a compressor 19 to a pressure of about 7.0–11.0 bar, preferably about 9.0 bar, and cooled in the main heat exchanger 5 to an intermediate temperature. A major portion of this further compressed air stream is then engine-expanded in a turbine 20 and introduced into the low-pressure stage 8 (via conduit 21). The turbine 20 is coupled mechanically to the compressor 19. In accordance with an advantageous embodiment of the invention, a portion (i.e., a minor portion) of the further compressed air is branched off via conduit 22 prior to engine-expansion in turbine 20 and conducted countercurrently to evaporating crude argon through the crude argon evaporator 16. During this step, the portion of further compressed air is at least partially liquefied, and subsequently introduced via conduit 23 and throttle valve 24 as backflow, i.e., reflux, into the high-pressure stage 7.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire texts of all applications, patents and publications, cited above, and of corresponding application German No. P 38 34 793.8, filed Oct. 12, 1988, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the production of a gaseous argon enriched product stream by low-temperature rectification of air wherein an air feedstream is compressed, prepurified, cooled and fed into a high-pressure stage of a two-stage rectification column and wherein an argon enriched product stream in the liquid phase is obtained downstream of the two-stage rectification, the improvement comprising:

branching off a partial stream of the compressed air prior to cooling;

further compressing, cooling, partially engine-expanding and delivering said partial stream to a low-pressure stage of said two-stage partial rectification column; and branching off a portion of said further compressed partial air stream, prior to engine expansion, and bringing said portion of further compressed air into heat exchange with said enriched argon product stream in the liquid phase.

2. A process according to claim 1, wherein the work produced during expansion of said partial stream of further compressed air is utilized for said further compression of said partial stream.

3. A process according to claim 2, wherein said unexpanded portion of further compressed air is delivered to said rectification column after said heat exchange with said enriched argon stream in the liquid phase.

4. A process according to claim 3, wherein, after said heat exchange with said enriched argon stream in the liquid phase, said unexpanded portion of said further compressed air is brought into indirect heat exchange with gas in the head of a crude argon column.

5. A process according to claim 2, wherein, after said heat exchange with said enriched argon stream in the liquid phase, said unexpanded portion of said further compressed air is brought into indirect heat exchange with gas in the head of a crude argon column.

6. A process according to claim 1, wherein said unexpanded portion of further compressed air is delivered to said rectification column after said heat exchange with said enriched argon stream in the liquid phase.

7. A process according to claim 6, wherein, after said heat exchange with said enriched argon stream in the liquid phase, said unexpanded portion of said further compressed air is brought into indirect heat exchange with gas in the head of a crude argon column.

8. A process according to claim 1, wherein, after said heat exchange with said enriched argon stream in the liquid phase, said unexpanded portion of said further compressed air is brought into indirect heat exchange with gas in the head of a crude argon column.

9. A process according to claim 8, wherein, after said further compressed air is brought into heat exchange with gas in the head of a crude argon column, the further compressed air is delivered to a low-pressure stage of said two-stage rectification column.

10. A process according to claim 1, wherein prepurification of said air feedstream is performed by delivering said air feedstream to a purification stage containing molecular sieves.

11. A process according to claim I, wherein said feedstream after prepurification is cooled by countercurrent heat exchange with at least one process product stream(s).

12. A process according to claim 11, wherein said process product streams are an enriched oxygen product stream and an enriched nitrogen product stream discharged from a low-pressure stage of said two-stage rectification column.

13. A process according to claim wherein said high-pressure stage of said two-stage rectification column is operated under a pressure of about 5.0–7.0 bar.

14. A process according to claim 1, wherein said low-pressure stage and said high-pressure stage of said two-stage rectification column are in heat exchange communication via a condenser-evaporator.

15. A process according to claim 1, wherein oxygen-enriched liquid is removed from the bottom of said high-pressure stage and delivered to said low-pressure stage of said two-stage rectification column.

16. A process according to claim 1, wherein said low-pressure stage of said two-stage rectification column is operated under a pressure of about 1.0–2.0 bar.

17. A process according to claim 1, wherein an oxygen stream having a substantial argon concentration is withdrawn from said low-pressure stage of said two-stage rectification column and delivered to a crude argon column from which is removed said enriched argon product stream in the liquid phase.

18. A process according to claim 17, wherein said enriched argon product stream, after removal from said crude argon column, is pressurized to about 3.0–5.0 bar prior to heat exchange with said portion of further compressed air.

19. A process according to claim 1, wherein an oxygen stream having a substantial argon concentration is withdrawn from said low-pressure stage of said two-stage rectification column and delivered to a crude argon column from which is removed a gaseous argon enriched product stream which is subsequently liquified to form said enriched argon product stream in the liquid phase.

20. A process according to claim 19, wherein said enriched argon product stream, after removal from said crude argon column, is pressurized to about 3.0–5.0 bar prior to heat exchange with said portion of further compressed air.

21. A process according to claim 1, wherein further compression of said partial stream of air results in an increase in pressure of said partial stream of air to about 7.0–11.0 bar.

22. A process according to claim 1, wherein, after heat exchange with said enriched product argon stream whereby said portion of further compressed is at least partially liquefied, said portion of further compressed air is expanded in a throttle valve and delivered to said high-pressure stage of said two-stage rectification column.

* * * * *

UNITED STATES PATENT AND TRADEMARK OFFICE

CERTIFICATE OF CORRECTION

PATENT NO. : 4,932,212

DATED : June 12, 1990

INVENTOR(S) : Wilhelm ROHDE

It is certified that error appears in the above-identified patent and that said Letters Patent is hereby corrected as shown below:

Column 5, claim 13, line 19:

reads "A process according to claim wherein said high-"

should read -- A process according to claim 1, wherein said high- --

Signed and Sealed this

First Day of October, 1991

*Attest:*

*Attesting Officer*

HARRY F. MANBECK, JR.

*Commissioner of Patents and Trademarks*